United States Patent [19]

Brown et al.

[11] Patent Number: 4,912,948

[45] Date of Patent: Apr. 3, 1990

[54] VACUUM GUIDE USED IN FLEXIBLE SHEET MATERIAL TREATMENT

[75] Inventors: Russell L. Brown, Charleston; Charles J. Cunningham, Elkview, both of W. Va.

[73] Assignee: Union Carbide Chemicals and Plastics Company Inc., Danbury, Conn.

[21] Appl. No.: 715,170

[22] Filed: Mar. 22, 1985

[51] Int. Cl.[4] ..... D06B 1/08

[52] U.S. Cl. ..... 68/205 R; 118/410; 162/279

[58] Field of Search ..... 68/200, 205 R; 118/410; 162/279; 198/495

[56] References Cited

U.S. PATENT DOCUMENTS

| | | | |
|---|---|---|---|
| 1,531,189 | 3/1925 | Johnson | 68/200 |
| 1,550,304 | 8/1925 | Dolan | 162/278 |
| 1,840,102 | 1/1932 | Jespersen | 162/279 |
| 2,368,662 | 2/1945 | Jordan | 162/278 |
| 3,190,793 | 6/1965 | Starke | 68/200 X |
| 3,722,469 | 3/1973 | Bartley et al. . | |
| 4,007,083 | 2/1974 | Ring et al. | 162/184 |
| 4,023,526 | 5/1977 | Ashmus et al. | 118/410 |
| 4,081,318 | 3/1978 | Wietsma | 162/182 |
| 4,099,913 | 7/1978 | Walter et al. | 8/477 |
| 4,141,231 | 2/1979 | Kudlich | 68/205 R |
| 4,158,076 | 6/1979 | Wallsten | 118/410 X |
| 4,184,914 | 1/1980 | Jenkins | 162/135 |
| 4,237,818 | 12/1980 | Clifford et al. | 68/200 X |
| 4,263,344 | 4/1981 | Radvan et al. | 427/391 |
| 4,343,835 | 8/1982 | Jones et al. | 68/200 X |
| 4,348,251 | 9/1982 | Pauls et al. | 156/500 |
| 4,353,993 | 10/1982 | McCrossin | 521/65 |
| 4,397,164 | 8/1983 | Binnersley | 68/200 |
| 4,402,220 | 9/1983 | Clifford et al. | 68/200 |
| 4,562,097 | 12/1985 | Walter et al. . | |

FOREIGN PATENT DOCUMENTS

| | | | |
|---|---|---|---|
| 603573 | 8/1960 | Canada | 162/279 |
| 680349 | 8/1939 | Fed. Rep. of Germany | 162/279 |
| 1141525 | 12/1962 | Fed. Rep. of Germany | 162/278 |
| 2359276 | 6/1975 | Fed. Rep. of Germany | 68/200 |
| 231131 | 1/1977 | France | 68/205 R |
| 46736 | 9/1939 | Netherlands | 162/278 |
| 595012 | 12/1947 | United Kingdom | 162/279 |
| 599947 | 3/1948 | United Kingdom | 162/279 |
| 629841 | 9/1949 | United Kingdom | 162/279 |

OTHER PUBLICATIONS

Paper Age, May 1984, "Twostream Coater-Versatile New Tools for Coating in Spotlight" Sivert Westergard.

*Primary Examiner*—Frankie L. Stinson
*Attorney, Agent, or Firm*—Henry H. Gibson

[57] ABSTRACT

Treating flexible sheet material, including paper, using vacuum guides adjacent to short-dwell applicators intimately contacting the sheet, provides improved application of fluid treating composition, particularly at high speeds.

7 Claims, 3 Drawing Sheets

VACUUM GUIDE USED IN FLEXIBLE SHEET MATERIAL TREATMENT

BACKGROUND OF THE INVENTION

1. Field of the Invention

This invention pertains to apparatus and processes used in treating flexible sheet material, and more particularly to vacuum guide/fluid applicator combinations used to apply fluid treating compositions to moving flexible sheet material, such as paper web, during papermaking and finishing operations.

2. Description of Background Information

The application of fluid treating compositions, including coatings, to flexible sheet materials has generally been accomplished using application devices, such as gapped rolls, squeeze rolls, curtain bars, doctor knives or spray nozzles, which generally involve the application of significant quantities of liquid to the flexible sheet material. Drying operations subsequent to the treating step are generally required to evaporate the applied liquid leaving an applied amount of solid treating agent. For example, such procedures have been used to apply paper treating agents during papermaking or finishing operations, but with recognized limitations.

Squeeze rolls involve contacting the flexible sheet material with a composition containing treating agent in the form of either a liquid or foam, immediately prior to passing the flexible sheet material through the rolls. Limitations in the use of treating agent which can be applied by squeeze rolls arise due to various limitations in their properties. The treating agent compositions must generally be low-viscosity, low-solids compositions since strong hydraulic forces generated between squeeze rolls operating at high speeds separate the rolls leading to loss of control in the amount of composition applied and other problems. Studies show that fluid penetration mechanisms govern pick-up such that a strength gradient from the sheet surface to the sheet center can develop, unless saturation occurs. The significant increase in moisture content of the sheet from squeeze roll applications requires added drying steps and apparatus, significantly increasing costs and limiting processing speed.

Spraying treating agent compositions onto flexible sheet material also has limited utility. Generally, only low-viscosity liquids can be utilized. Limitations in the uniformity of application of treating agent compositions also exist. Sensitivity to spray nozzle design and performance, as well as inherent limitations in spray configurations and overlap, leads to inefficient distribution. Spraying often provides uneven deposition, particularly for wide sheet material, such as used in papermaking operations. Spraying is also sensitive to air currents which may affect uniformity of deposition. Certain treating agents may not be sprayed for environmental reasons due to risks of being spread through the air.

Various high-solids compositions have been developed attempting to alleviate drying restrictions enabling increased application rates. Foamed compositions have been used since volumetric expansion of the composition for obtaining uniform coverage is provided by using gas in place of liquid reducing the need for drying operations.

These foam systems, however, are not fast breaking but are designed to provide foamed treating compositions used as a pond or reservoir using traditional fluid application means, such as air-knives, rolls, brushes or the like, followed by subsequent disintegration of the foam using squeeze rolls, doctoring blades or the like. The effective use of such foam application procedures requires foamed treating compositions of sufficient stability such that when exposed to air the foam does not randomly or unevenly break down to liquid causing uneven wetting of the substrate and/or uneven doctoring by blade or squeeze rolls used in the traditional application procedures. Furthermore, recycling of such compositions to maintain composition consistency is usually difficult and impractical.

Developments in treating operations have led to high efficiency, short-dwell treating devices which permit the use of high solids treating compositions. Such systems reduce the amount of liquid applied to the flexible sheet material, thereby reducing the energy required to evaporate the liquid during subsequent drying operations, often enabling higher application rates providing increased productivity and lower costs. Such short-dwell treating operations enable the application of reduced amount of treating compositions, thereby further reducing costs. Additionally, the short-dwell applications permit higher application rates by reducing or eliminating the need for liquid reservoirs or "ponds" having the previously described disadvantages.

Short-dwell fluid treating applications are described in, for example, "Surface Treatment Under Vacuum", by R. Akesson, *Paper Technology and Industry* May/-June, 1977; "14 Years of Progress in Coatings—from Billblade to Twinblade" by W. Williams, *Paper,* May 5, 1980; "Twostream Coater-Versatile New Tools for Coating in Spotlight", S. Westergard, *Paper Age,* May 1984. Additional short-dwell fluid treatment applications are described in U.S. Pat. No. 3,941,902 (Wennerblom et al.) and U.S. Pat. No. 4,023,526 (Ashmus et al). When using the procedure described in the Ashmus et al. patent, the impingement of the fluid treating composition upon the substrate can lift the substrate away from the foam applicator nozzle lips resulting in leakage and spillage of foam.

The critical feature of short-dwell treating applications involves the requirement for intimate contact between the flexible sheet material and the orifice of the fluid applicator to enable satisfactory application of the fluid treating composition to the flexible sheet material without spillage while providing uniform deposition of treating composition.

Typically, short-dwell fluid treating applications have involved placing the flexible sheet material between rolls or similar guiding devices which are disadvantageous in being bulky, requiring precision speed control and being of varying diameter causing an uneveness of the flexible sheet material. Alternatively, an expensive "bow" roll can be used to provide uniform flatness of wide flexible sheet material contacting the fluid applicator.

There is therefore a need to provide a fluid applicator having the advantages of short-dwell fluid application operations, but which avoids the bulky, expensive or inefficient means for providing the requisite intimate contact with the orifice of short-dwell fluid applicators. Such fluid application operations should operate at relatively high substrate speeds and be useful in a continuous application operation, such as papermaking or finishing operations. It would be desirable if the treating application would introduce a minimum of induced tensile drag on the flexible sheet material by providing an adjustable application of force to generate sheet smoothness. Ideally, treatment operations should maintain intimate contact between the flexible sheet material and the fluid applicator despite small but significant height variations across the width of the fluid applicator.

SUMMARY OF THE INVENTION

This invention pertains to an apparatus and process for treating moving flexible sheet material. The apparatus comprises two essential components in combination. A first component comprises (1) a vacuum guide having a surface for holding flexible sheet material with one or more openings in the surface. The openings extend to a chamber connected to vacuum generation means. A second component comprises (2) a short-dwell, fluid applicator adjacent to the vacuum guide. The applicator has a pair of lips extending in line with, or beyond, a plane defined by the guide surface. A fluid application chamber extends between the lips. The applicator is aligned with the vacuum guide sufficient to provide contact along the entire width of the applicator lips with a cross section of flexible sheet material passing to, or from, the guide surface across the applicator lips.

The process comprises the following essential steps. A first step comprises (1) passing flexible sheet material to a fluid applicator. A second step comprises (2) pulling a cross section of the flexible sheet material onto a surface of a vacuum guide using a vacuum through one or more openings in the surface to align the flexible sheet material with a short-dwell, fluid applicator adjacent to the vacuum guide. A third step comprises (3) passing the aligned flexible sheet material across a pair of lips of the applicator providing contact along the entire width of the applicator lips with a cross section of flexible sheet material. A fourth step comprises (4) applying fluid treating composition between the fluid applicator lips onto the flexible sheet material contacting the applicator. A fifth step comprises (5) recovering the treated flexible sheet material.

DETAILED DESCRIPTION OF THE INVENTION

This invention provides an apparatus and process for treating movable flexible sheet material, suited to short-dwell fluid application operations, by providing simple, effective, inexpensive and efficient means to obtain the requisite intimate contact between the treated flexible sheet material and orifice of short-dwell fluid applicators. The system of this invention operates at relatively high substrate speeds; is useful in a continuous application operation, particularly papermaking or finishing operations; provides minimal drag on the flexible sheet material through readily adjustable control; and is uniquely suited to maintain intimate contact between the flexible sheet material and the fluid applicator having small but significant slight variations along the contact edges.

An illustrative embodiment of the apparatus and process of this invention is shown in the figures. It is noted that the figures are not drawn to scale but provide schematic representations of embodiments facilitating discussion and understanding of this invention.

Dimensional orientation as used in the context of this invention, unless otherwise indicated, is such that length is measured along the direction of paper movement and across the foam applicator lips, width is measured across the paper web and along the foam applicator lips and height is measured in terms of the direction perpendicular to the paper sheet.

Figure 1:
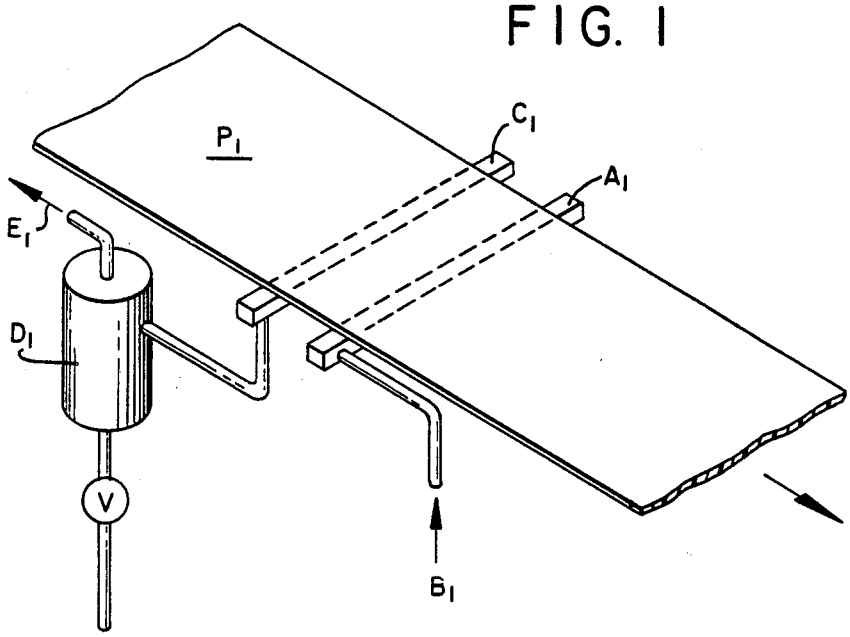
FIG. 1 is a schematic elevated view illustrative of an embodiment of this invention.

Referring to FIG. 1 of the drawings, fluid applications means $A_1$ comprises a short-dwell fluid applicator contacting the flexible sheet material $P_1$. Fluid treating composition $B_1$ is provided from fluid generation means, not shown in the drawings. A vacuum guide $C_1$ is provided adjacent to the fluid applicator having one or more openings in the surface for holding flexible sheet material $P_1$ by enabling a vacuum force to contact the sheet being treated. A vacuum gauge, not shown in the drawings, may be attached to the vacuum guide $C_1$ to measure the vacuum force contacting the flexible sheet material $P_1$. The vacuum guide $C_1$ may be connected to separtion means $D_1$ between the vacuum guide $C_1$ leading to vacuum generation means $E_1$, not shown in the drawings. The direction of flexible sheet material movement in FIG. 1 is shown as from left-to-right such that the vacuum guide means $C_1$ is upstream of the foam applicator $A_1$.

Figure 2:
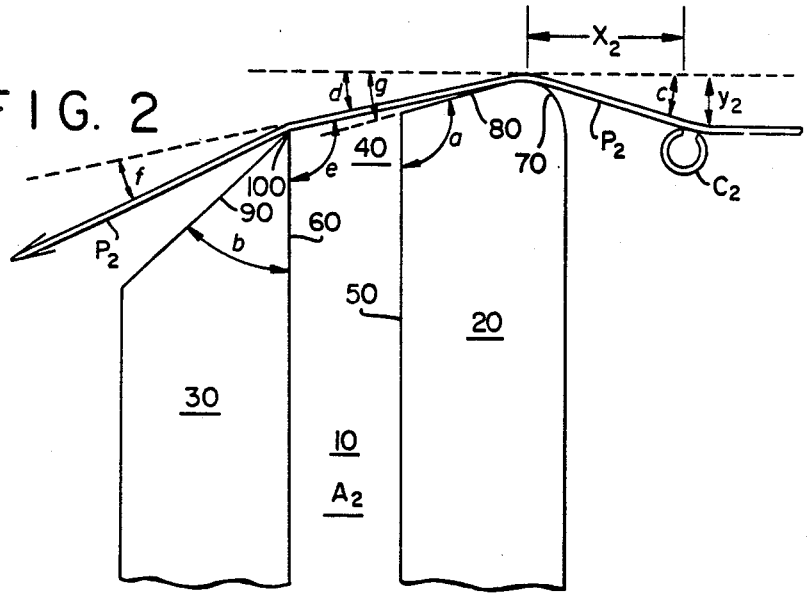
FIG. 2 is a schematic end view showing relative positions of a preferred embodiment of this invention.

Referring to FIG. 2 there is shown an expanded end view of a preferred foam applicator $A_2$ and vacuum guide $C_2$. The direction of movement of flexible sheet material $P_2$ in this FIG. 2, and in subsequent FIGS. 3 through 7, is from right-to-left, such that in FIG. 2 the vacuum guide $C_2$ is upstream of the foam applicator $A_2$.

In FIG. 2, a fluid application chamber 10 extends between an upstream lip 20 and a parallel downstream lip 30 both extending angularly from a base, not shown in the figure. Fluid treating composition proceeds through the fluid applcation chamber 10 to orifice 40 at the end of the fluid application chamber distant from the base. When the fluid treating composition contacts the flexible sheet material $P_2$ at the orifice 40, a uniform distribution of liquid treating composition is deposited on the flexible sheet material $P_2$.

The fluid application chamber 10 extends between interior wall 50 of the upstream lip 20 and interior wall 60 of the downstream lip 30, being enclosed at each end by end walls, not shown. An end outside edge 70 and an end inside edge 80 define the end of the upstream lip 20 away from the base. An end outside edge 90 and a rim 100 between the end outside edge 90 and the interior wall 60 define the end of the downstream lip 30 away from the base.

An angle a is formed by the interesection of the end inside edge 80 and the interior wall 50 of the upstream lip. A relief Angle b is formed by the intersection of the end outside edge 90 and the interior wall 60 of the downstream lip. Angle a is greater than 90°, preferably from about 91° to about 135°, and most preferably from about 105° to about 125°. Angle b is less than 90°, preferably from about 1° to about 70°, and most preferably about 45°. As can be seen in the drawings, the end of upstream lip 20 extends farther from the base than does the end of the downstream lip 30.

The edges of the upstream lip 20 and the downstream lip 30 in contact with the substrate may be of any selected configuration, while maintaining the previously described orientations. The edges may be pointed, tapered, flat, beveled, arched or otherwise curved. To the extent that the interior wall 50 or the end inside edge 80 of the upstream lip 20, or the interior wall 60 or the end outside edge 90 of the downstream lip 30, are curved surfaces. Angles a or b are defined by the intersection of lines extending from the flat portion of such surfaces. If no flat portion exists for such surfaces. Angles a and b are defined by the intersection of lines extending from the midpoint of the curve intersecting such surfaces to the end of the surface furthest from the intersection. It is preferred that the length of the rim 100 of the downstream lip 30 be either sharp or of similar narrow configuration.

The distance x between the surface of the vacuum guide $C_2$ and the contact with the foam applicator, which distance is designated $x_2$ in FIG. 2, is not critical so long as the vacuum guide $C_2$ is sufficiently close to the fluid applicator $A_2$ to assist in the requisite intimate contact between the flexible sheet material $P_2$ and the lips 20 and 30 of the fluid applicator $A_2$. The distance x is preferablly as small as possible, and may be 0 when the surface of the vacuum guide is connected to a lip of the fluid applicator $A_2$. For example, for flexible sheet materials of low stretch modulus values such as thin sheets of low modulus polymers or damp paper, the distance x is as short as structurally conventient.

Typically, the distance x between the vacuum guide and the foam applicator is from 0 up to about 20, preferably less than about 10, and most preferably from 0 up to about 1, inches.

The distance y that the vacuum guide $C_2$ is away from perpendicular (shown by the horizontal dotted line in FIG. 2), is not critical but may range from 0 up to a distance beyond which intimate contact between the vacuum device and the flexible sheet material cannot be practically maintained. Typically, the distance y is between 0 to about 2, preferably up to about 1, and most preferably from about 0.10 to about 0.25, inches.

A cross section of flexible sheet material $P_2$ is in contact along the entire end width of the upstream lip 20 covering the intersection between the end outside edge 70 and the end inside edge 80. A cross section of the flexible sheet material $P_2$ is also in contact along the entire end width of the rim 100 of the downstream lip 30. These contacts are sufficient to form a seal over orifice 40 extending between the upstream lip 20 and the downstream lip 30. This seal is provided by a combination of flexible sheet material tension and the configuration defined by the sheet passing across the applicator lips 20 and 30, assisted by vacuum guide $C_2$.

An upstream entrance angle, Angle c, at which the flexible sheet material $P_2$ approaches the upstream lip 50 away from perpendicular is from greater than or equal to 0° up to less than 90°, preferably greater than 0° to about 60°, and most preferably greater than from about 15° to about 45°. An upstream exit angle, Angle d, at which the substrate 80 leaves the upstream lip 20 away from perpendicular and towards the base 30 is between 0° and 90°, preferably up to about 50°, and most preferably from about 1° to about 25°. A downstrea lip 30 entrance angle, Angle e, at which the flexible sheet material $P_2$ approaches the downstream lip 30 away from the interior wall 100 of the downstream lip 30 is between 90° and 180°, preferably up to about 140°, and most preferably from about 91° to about 115°. A downstream exit angle, Angle f, at which the flexible sheet material $P_2$ leaves the downstream lip 30 away from the direction of approach to the upstream lip 60 (shown by the dotted line extension in FIG. 2) is from greater than or equal to 0° up to less than 90°, preferably up to about 60°, and most preferably from about 15° to about 45°. The sum of Angles e and f is less than 180°.

As can be seen in FIG. 2, the upstream exit Angle d defines in angular terms how far the upstream lip 20 extends farther from the base than does the downstream lip 30.

The upstream lip 20 has a relief Angle g defined by the extent to which the end inside edge 80 slopes away from perpendicular and towards the base. As such the upstream lip relief Angle g equals the value of the upstream lip Angle a minus 90°. The upstream lip relief Angle g is at least equal to, preferably greater than, and most preferably from about 1° to 30° greater than, the upstream exit Angle d.

Figure 3:
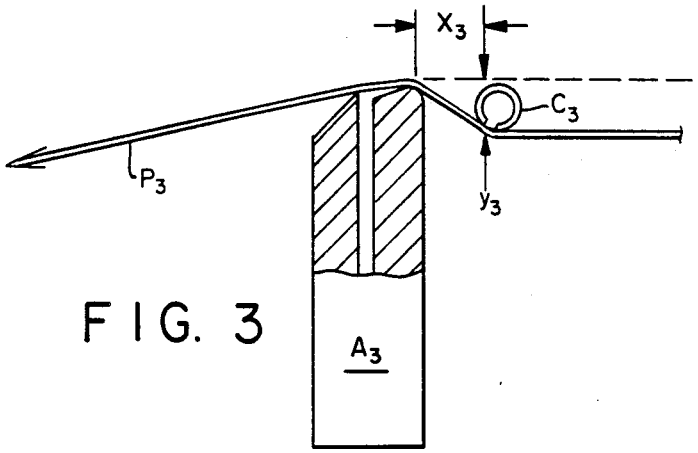
FIGS. 3 through 7 are schematic end views showing various alternative embodiments of this invention.

Referring to FIG. 3, a vacuum guide $C_3$ is positioned above the flexible sheet material $P_3$ a distance $x_3$ from the fluid applicator $A_3$ and provides a distance $y_3$ that the flexible sheet material $P_3$ is away from the perpendicular in approaching the fluid applicator $A_3$.

Figure 4:
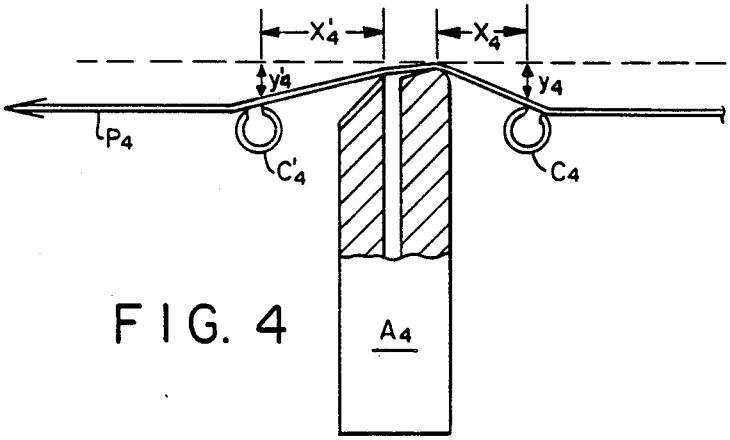

Referring to FIG. 4, two vacuum guides $C_4$ and $C'_4$ are positioned on each side of the foam applicator $A_4$, at a distance $x_4$ and $x'_4$, respectively, and at a distance $y_4$ and $y'_4$, respectively, away from perpendicular. In this configuration, the vacuum imposed on the flexible sheet material may be less than the vacuum imposed when only one vacuum guide is provided.

Figure 5:
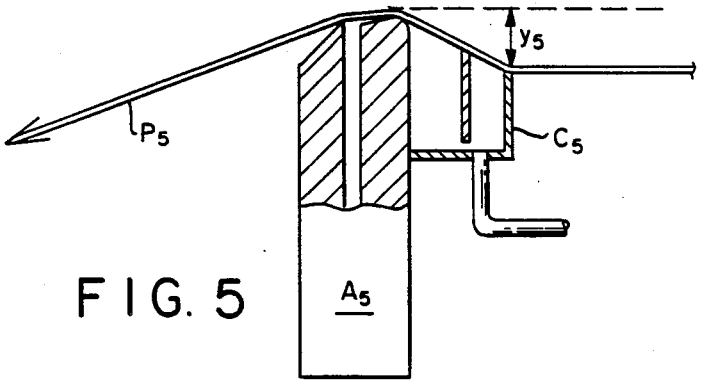

Referring to FIG. 5, vacuum guide $C_5$ is constructed to be connected to the fluid applicator $A_5$. It is also shown that there may be no separation, in that dimension x is 0, between the surface of the vacuum guide $C_5$ and the lips of the fluid applicator $A_5$. The flexible sheet material $P_5$ is a distance $y_5$ away from perpendicular in approaching fluid applicator $A_5$.

Figure 6:
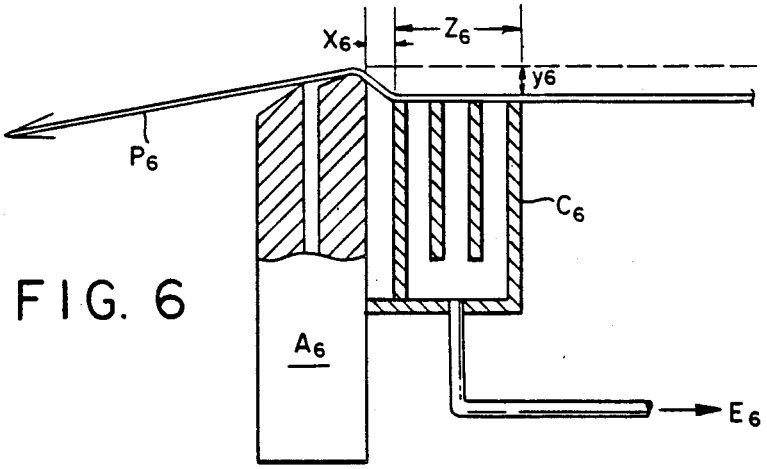

Referring to FIG. 6, a vacuum guide $C_6$ is connected to the fluid applicator $A_6$ providing a distance $x_6$ between the surface of the vacuum guide $C_6$ and the contact with the fluid applicator $A_6$. The flexible sheet material $P_6$ is a distance $y_6$ away from perpendicular in approaching the fluid applicator $A_6$, and travels a distance $z_6$ across the surface of the vacuum guide $C_6$.

Figure 7:
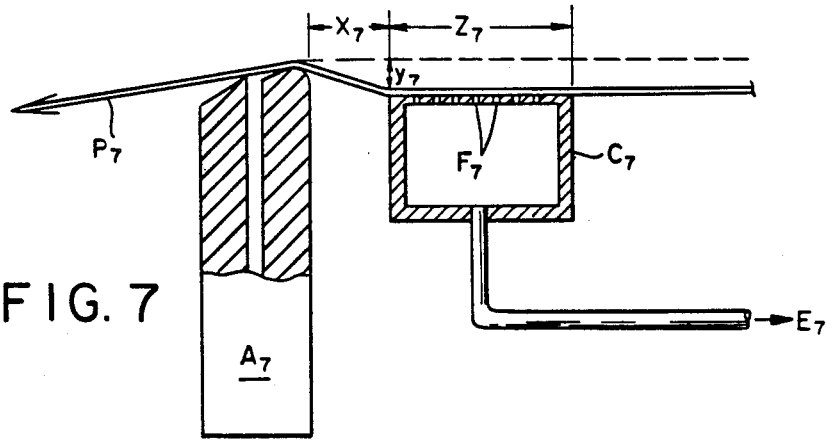

Referring to FIG. 7, the surface of the vacuum guide $C_7$ is provided, as a plate having perforations $F_7$. The length $z_7$ traveled by the flexible sheet material $P_7$ across the surface of the vacuum guide $C_7$ is not critical so long as a minimum length is provided to establish a sufficient vacuum to hold the flexible sheet material onto the surface of the vacuum guide $C_7$. Typically, the length of the surface of the vacuum guide is between 0.03 to about 4, preferably from about 0.06 to about 2, and most preferably from about 0.1 to about 0.5 inches.

The fluid applicator of this invention is a short-dwell device in that the fluid-treating composition is applied to the flexible sheet material in a relatively short period of time using a relatively short application zone. Typically, the fluid treating composition is applied to the flexible sheet material in less than about 0.01, and preferably less than about 0.0001, seconds.

The vacuum guide, aligned and adjacent to the fluid applicator, may be positioned either upstream or downstream or both of the fluid applicator, relative to the movement of the flexible sheet material. The vacuum guide uses vacuum force to pull a cross-section of flexible sheet material onto the surface of the vacuum guide. This vacuum is typically between about 1 to about 8 psi. The vacuum is preferably insufficient to pull any liquid or foam substance from or onto the flexible sheet material. The vacuum force is preferably adjustable, typically through modification of the vacuum produced by the vacuum generation means.

The foam applicator and vacuum guide are aligned in that the surface of the vacuum guide and lips of the fluid applicator are oriented in a parallel direction to insure intimate contact with flexible sheeting material passing across the fluid applicator lips. The lips of the fluid applicator are in-line or extend beyond a plane defined by the guide surface.

When upstream of the fluid applicator, the vacuum guide positions the flexible sheet material to approach the upstream lip at upstream entrance Angle c. When downstream of the fluid applicator, the vacuum guide positions the flexible sheet material to leave the downstream lip at the downstream exit Angle F.

In a preferred embodiment, the vacuum guide may be advantageously used to prevent the spillage of excess fluid treating compositon during start-up and shutdown, i.e. before and after, a continuous treating operation. This may be achieved by connecting the surface of the vacuum guide to either or both the upstream or downstream lips of the fluid applicator.

In operation, as in the process of this invention, a positive pressure above ambient develops within the fluid application chamber 10. This pressure may be monitored using pressure sensing devices, such a manometer or pressure gauge, which is connected to the fluid application chamber 10. The amount of pressure is that which is sufficient to provide for the deposition of fluid treating composition onto the moving substrate. The amount of pressure will depend upon various factors including fluid density, rate of fluid flow, rate of substrate motion, absorbency of the substrate and the porosity of the substrate. This positive pressure i.e., greater than 0, will generally range from about 0.01 to about 10, preferably from about 0.1 to about 3.0, and most preferably from about 0.3 to about 1, psi.

The class of flexible sheet material treated by this invention pertains to metallic foil and light weight sheet materials; polymeric flexible sheet such as polyethylene, polypropylene, cellophane, polyacrylate, polyamid, polyester or polycarbonate films used as wrapping, decorative covering or in other functional uses; and paper webs, including particularly paper produced in wet-laid papermaking operations. The process of this invention is particularly suitable to substantially non-porous paper relatively low in permeability. Illustrative flexible sheet materials include sheet metals of steel, aluminum, magnesium or the like stored in coil form and used for exterior coverings of structures: thin foils such as aluminum foil used as wrapping and packaging materials; polymeric films of acrylates, olefins, (poly)esters, (poly)carbonates, (poly)aramids used as wrapping and protective coverings for foods and other articles of commerce; non-porous paper such as unfinished writing paper, book paper, newsprint, linerboard, boxboard, containerboard and the like, and porous paper such as tissue, filtration grade paper and the like. The flexible sheet material may have any level of moisture content from dry up to near saturation.

Liquid treating compositions used in the process of this invention consist essentially of substrate treating agent and liquid vehicle. The composition will also usually contain a foaming agent. The substrate treating agent is the active material which is distributed onto the flexible sheet material. The liquid vehicle is generally required as a carrier to assist in the deposition of the paper treating agent onto the flexible sheet material. The substrate treating agent may be provided in the liquid vehicle in any form, such as by dispersion, emulsification, solvation, or other means known in the art.

The substrate treating agent used in the process of this invention pertains to the class of materials recognized by those skilled in the art as having utility when applied to flexible sheet materials. Typical substrate treating agents include paints, varnishes and similar decorative coatings; corrosion inhibition coatings; barrier coatings to prevent moisture, chemical or air transfer agents; static electricity inhibition agents; surface character modifiers such as lubricants, anti-skid agents; release coatings and the like; functional and performance chemical additives for paper, such as product performance and process performance chemicals. Illustrative substrate treating agents include paints of either solvent or water vehicle types containing coloring pigments and polymers of the acrylic, polyester olefin, acetate or combinations thereof; varnishes composed of liquid vehicle and natural or synthetic origin resins; sizing aids such as starches, casein, animal glue, synthetic resins including polyvinyl alcohol and the like materials which may be applied to the pulped slurry or to the formed sheet; binders, including wet strength or dry strength resins, such as polymers and copolymers of acrylamide, acrylonitrile, polyamide, polyamine, polyester, styrene, ethylene, maleic acid, acrylic acid, acrylic esters and materials such as rosin, modified gums, glyoxal and the like; coloring agents including dyes such as the class of direct, reactive and fluorescent dyes and pigments such as titanium dioxide or the like whitening agents, or organic color types commonly used to color paper; oil or water repellents; defoamers to the extent the foaming agent is not rendered inoperative; fillers; slimicides; latex; saturants; wax emulsions; and the like. Blends of more than one substrate treating agent may be used.

The concentrations of substrate treating agent is not critical so long as an effective amount is provided to the flexible sheet material to provide treated substrate having the desired properties, based on well-established practices in the art. The particular concentration of substrate treating agent desired will vary depending upon the particular type of substrate treating agent, rate of fluid application, rate of flexible sheet material movement, substrate properties and the like considerations, which determine the amount of substrate treating agent desired on the treated substrate. The concentration of substrate treating agent in the fluid treating composition is usually from about 1 wt. % to about 70 wt. %, preferably from about 2 wt. % to about 50 wt. %, and most preferably from about 4 wt. % to about 30 wt. % paper treating agent in the liquid vehicle.

The particular type of liquid vehicle is not critical so long as it performs the function of assisting deposition of the substrate treating agent onto the flexible sheet material. Illustrative liquid vehicles include water, organic solvents and the like materials which are compatible with the flexible sheet material used, and preferably papermaking or finishing operations. Water is the preferred liquid vehicle.

The fluid treating composition of this invention may be applied either as a liquid or preferably, as a foam.

Preferably, the fluid treating composition used in the process of this invention will usually contain a foaming agent in an amount effective to provide a foam having a desired structure. In some instances the substrate treating agent may possess sufficient foaming properties to provide the foam structure. In such cases the substrate treating agent is also the foaming agent. The particular type of foaming agent is not critical but may be selected from the class of foaming agents recognized by those skilled in the art as capable of forming the desired foam. Typically, foaming agents are surfactants, i.e. surface active agents, which will operate to provide the desired foam characteristics.

Illustrative foaming agents include (1) nonionic or anionic surfactants, such as: ethylene oxide adducts of long-chain alcohols or long-chain alkyl phenols, such as mixed $C_{11}$–$C_{15}$ linear secondary alcohols containing from about 6 to 50, preferably from about 10 to 20, ethyleneoxy units, $C_{10}$–$C_{16}$ linear primary alcohols containing from about 6 to about 50, preferably from about 10 to 20, ethyleneoxy units, $C_8$–$C_{12}$ alkyl phenols containing from about 6 to about 50, preferably from about 10 to about 20, ethyleneoxy units: fatty acid alkanolamides, such as coconut fatty acid monoethanolamide: sulfosuccinate ester salts, such as disodium N-octadecylsulfosuccinate, tetrasodium N-(1,2-dicarboxyethyl)-N-octadecylsulfosuccinate, diamyl ester of sodium sulfosuccinate acid, dihexyl ester of sodium sulfosuccinic acid, diocytl ester of sodium sulfosuccinic acid, and the like: or (2) cationic or amphoteric surfactants, such as: distearyl pyridinum chloride: N-coco-beta-aminopropionic acid (the N-tallow or N-lauryl derivatives) or the sodium salts thereof: stearyl dimethyl benzyl ammonium chloride; the betaines or tertiary alkylamines quaternized with benzene sulfonic acid; or the like. Such foaming agents are well known and any similar surfactant can be used in addition to those previously identified. Blends of more than one foaming agent may be used. In selecting the foaming agent for a particular foam, care must be exercised to use those agents which will not unduly react with the other agents present or interfere with the foaming or treating process.

Additional adjuvants may optionally be provided to the fluid treating composition consistent with those procedures established in the art, including: viscosity modifiers such as organic plasticers, water soluble polymeric thickening agents like gums, modified celluloses, acrylate and urethane polymers which may also function as foam stabilizers or also as wet film levelling agents: solvents or co-solvents which function as filming aides (such as Carbitol® and Cellosolve®): pigment dispersants and solution stabilizers: hydrotropes to promote solution compatability among ingredients: wetting agents: foam stabilizers such as hydroxyethyl cellulose, methyl cellulose, methyl hydroxyethyl cellulose or hydrolyzed guar gum: heat sensitizers: setting agents: dispersants: screening agents: antioxidants: to the extent that such adjuvants do not unduly affect the desired fluid properties or application of treating agent to the flexible sheet material. The concentration of foaming agent or adjuvants which may be provided follows those practices established in the art.

The particular sequence of addition of components in the fluid treating composition is not critical, but may be achieved by mixing a liquid vehicle, substrate treating agent, foaming agent, and other optional additives in any desired sequence, following those practices in the art.

The foam which may be used in this invention contains gas and liquid treating composition. The gas is required as the vapor component of the foam. The gas may be any gaseous material capable of forming a foam with the liquid treating composition. Typical gas materials include air, nitrogen, oxygen, inert gases, or the like. Air is the preferred gas.

The relative proportion of liquid treating composition to gas is not critical beyond that amount effective to provide the required, uniform foam structure in the foam applicator.

Preferred foams which may be provided are fast-breaking, low wetting, and have limited stability. Such foams are fast-breaking having limited stability in that the foam reverts substantially immediately to liquid upon contact with the substrate. Such foams are low-wetting in that relatively low amounts of liquid vehicle are applied to the substrate. Such foams have a uniform structure in that the treating composition, including paper treating agent, is evenly distributed throughout the foam.

The foam preferably has a density, bubble size and half-life as described in U.S. Pat. No. 4,099,913 (Walter et al.), incorporated herein by reference. Typically, the density of the foam can range between about 0.005 to about 0.8, preferably 0.01 to about 0.6, grams per cubic centimeter. The foams generally have an average bubble size of between 0.05 to about 0.5, and preferably 0.8 to about 0.5, millimeters in diameter. The foam half-life is generally from about 1 to about 60, preferably from about 3 to about 40, minutes.

Particularly preferred foams are described in cofiled U.S. patent application Ser. No. 715,169 (Brown et al.), entitled "Foam Compositions Used in Paper Treatment", now U.S. Pat. No. 4,571,360 incorporated herein by reference.

The preferred foam is produced by established foam generation means known in the art, such as the well known axial, radial or static types. Foam generation means generally consist of a mechanical agitator capable of mixing metered quantities of gas and liquid treating composition. The foaming is controlled by adjusting the volume of gas introduced into the foaming apparatus and the rotation rate of the rotor in the foaming apparatus. The rotation rate is significant in providing a foam that would have the desired bubble size and half-life. The relative feed rates of the liquid composition and gas will determine the denisty of the foam. Once generated, the foam passes to the foam applicator and is applied to the paper substrate as previously described.

The rate at which the flexible sheet material passes across the fluid applicator may vary over a wide range, including those ranges typical in papermaking and finishing operations. Typically, the flexible sheet material will be supplied at a rate of at least about 200, preferably from about 400 to about 6000, and most preferably from about 500 to about 3500, feet per minute.

The temperature conditions at which the fluid treating composition is produced and applied to the flexible sheet material are not critical but follow the practices established in the art. Typically, the temperature may range from ambient up to 100° C. or more in cases where the substrate treating agent is heated prior to and/or during application.

Single or multiple fluid applicators and steps may be provided. Fluid treating composition may be applied to either or both sides of the flexible sheet material. In multiple or two-sided applications, each fluid applicator may be supplied with the same or different fluid treating composition produced in one or more fluid generation means. In multiple or two-sided applications the amount and composition of the applied fluid may be equal or different among the various applications. Multiple fluid application steps may be in direct succession or separated by other process steps, as may be used in papermaking operations.

In a typical embodiment fluid treating composition, including preferably a meterd quantity of liquid treating composition foamed with a metered quantity of gas in a commerically available foam generation means, is passed, using appropriate conveying means, to a fluid distribution chamber of a short-dwell fluid applicator. Preferably the fluid passes through one or more openings in the base of the fluid applicator to provide a positive pressure and uniform distribution of fluid in a fluid application chamber, extending between interior walls of an upstream lip and a parallel downstream lip which extend angularly from the base of the fluid applicator. The upstream lip has an end inside edge intersecting the interior wall at an angle greater than or equal to 90°. The downstream lip has an end outside edge intersecting the interior wall at a downstream relief angle less than 90°. A flexible sheet material is passed across the fluid applicator, assisted by at least one vacuum guide adjacent to and aligned with, the fluid applicator wherein the vacuum guide has a surface for holding flexible sheet material using one or more openings in the surface connected to vacuum generation means, providing contact between the flexible sheet material along the entire width of a top edge of the upstream lip and along the entire width of a rim between a top outside edge and the interior wall of the downstream lip. The flexible sheet material approaches the upstream lip at an upstream entrance angle at zero or more degrees away from perpendicular and leaves the upstream lip at a positive upstream exit angle away from perpendicular and towards the base. The flexible sheet material approaches the downstream lip at a downstream entrance angle greater than 90° away from the interior wall of the downstream lip, and leaves the downstream lip at a downstream exit angle of zero or more degrees from the direction of approach to the downstream lip. A controlled amount of the fluid is applied to the surface of the flexible sheet material passing across the orifice of the fluid application chamber providing a uniform distribution of the treating composition on the flexible sheet material.

The following examples are illustrative of some embodiments of this invention, and are not intended to limit the scope thereof.

EXAMPLES

EXAMPLES 1-5

In these examples, starch solution coatings were applied to a paper sheet. Aqueous liquid compositions containing 12 wt. % cooked starch and an appropriate level of n-dodecyl amido betaine as foaming agent to enable the designated foam generation.

The treating operation was conducted using a process and apparatus as described in U.S Pat. No. 4,023,526 (Ashmus et al.). Metered quantities of the foamable liquid treating composition and air were mixed in a foam generator and then applied using the described foam applicator on internally sized vellum web weighing 89.6 g/m$^2$ moving at about 1500 feet per minutes across the lips of the applicator.

EXAMPLE 1

In this example, a foam applicator/vacuum guide combination, such as that schematically shown in FIG. 4, was used having vacuum guides fabricated of 0.5 inch pipe (I.D.) with a 0.063 inches slot cut lengthwise 1 inch shorter than the width of the paper web being treated. The coating process was operated as follows:

| | |
|---|---|
| Paper Speed | 1500 ft/min |
| Wet Coat Weight | 10.3 g/m$^2$ |
| Foam Density | 0.082 g/cc |
| Foam Pressure | 2.5 psi |
| Vacuum Level | 5.9 psi |
| Application | No leakage of foam or liquid |

EXAMPLE 2

In this example a foam applicator/vacuum guide combination, such as that schematically shown in FIG. 5, was used having a vacuum guide connected to the upstream lip of the fluid applicator. The length of the vacuum guide in the machine direction was approximately 0.09 inches.

The paper web was treated with the treating composition under the following conditions:

| | |
|---|---|
| Paper sheet speed | 1500 ft/min |
| Wet coat weight | 10.3 g/m$^2$ |
| Foam density | 0.32 g/cc |
| Foam pressure | 0.51 psi |
| Vacuum level | 4.9 psi |
| Application | no leakage of foam or liquid |

Before and after the continuous process operation, some foam from the applicator was picked-up by the vacuum guide and was collected in the separator as shown in FIG. 1, providing the additional advantage of avoiding spillage of the foam when the treatment is not in full operation.

EXAMPLE 3

In this example a foam applicator/vacuum guide combination, such as that schematically shown in FIG. 6, was used having an approximate 0.063 inch distance $x_b$ between the vacuum guide and the fluid applicator and approximately 0.063 inch openings between the substrate support bars in the vacuum guide.

The paper web was treated with the foam treating composition under the following conditions:

| | |
|---|---|
| Paper Sheet Speed | 1500 ft/min |
| Wet Coat Weight | 10.3 gm/m$^2$ |
| Foam Density | 0.50 g/cc |
| Foam Pressure | 2.17 psi |
| Vacuum Level | 5.4 psi |
| Application | No leakage of foam or liquid |

EXAMPLE 4

In this example a foam applicator/vacuum guide combination, such as that schematically shown in FIG. 7, was used having a distance $x_7$ between the vacuum guide and the fluid applicator of approximately 0.125 inches. The machine direction length of the vacuum guide with a perforated metal sheet surface was approximately 1.25 inches.

The paper web was treated with the treating composition under the following conditions in several runs:

| | |
|---|---|
| Paper Sheet Speed | 1500 ft/min |
| Foam Density | 10.3 gm/m$^2$ |
| Foam Pressure | various (between 0.4–3 psi) |
| Vacuum Level | 4.4–4.9 psi |
| Application | No foam or liquid leaks at application |

EXAMPLE 5

In this example a foam applicator/vacuum guide combination, such as schematically shown in FIG. 3, was used having a distance $x_3$ between the vacuum guide and the fluid applicator of approximately 0.75 inches. The vacuum guide was approximately 0.063 inches long in the machine direction having been cut in a 0.5 inch I.D. stainless steel pipe.

The paper web was treated with the foam trating composition under the following conditions:

| | A | B | C |
|---|---|---|---|
| Paper Speed (ft/min) | 800 | 2500 | 1500 |
| Paper Moisture Content (Weight %) | 5.2 | 5.2 | 19.0 |
| Wet Coat Weight (g/m$^2$) | 10.3 | 10.3 | 10.3 |
| Foam Density (g/cc) | 0.4 | 0.4 | 0.3 |
| Foam Pressure (psi) | 0.18 | 0.04 | 0.22 |
| Vacuum level (psi) | 5.9 | 5.9 | 2.94 |
| Application | No leakage of foam or liquid | | |

This example shows a range of substrate speeds and a range of substrate moisture contents which can be used within the scope of this invention.

EXAMPLES 6–8

In these examples a liquid treating composition composed of 12 wt. % cooked starch and 88 wt. % water was applied to a moving paper web as a liquid without foaming. The liquid coating composition was furnished to the fluid applicator using a metering pump to provide constant flow. The fluid applicator consisted of a slot bounded by lips as schematically represented in FIGS. 3, 6 and 7, which lips were in direct contact with the moving paper web.

The following examples describe the vacuum guides used to hold the moving paper web against the fluid applicator slot for overcoming the pressure of liquid application so that no leakage or spillage of liquid occurred at application.

The paper web material that received the treatment, weighing 89.6 g/m$^2$, was prepared from bleached fibers and was internally sized. The treated paper was tested for water drop contact angle, an indication of wettability, and ranged from 90° to 100° on various parts of the paper, as tested by TAPPI Test Method T-458.

EXAMPLE 6

In this example a foam applicator/vacuum guide combination, such as schematically shown in FIG. 6, was used having a distance $x_6$ between the vacuum guide and the fluid applicator of approximately 0.063 inches. The vacuum guide openings were each approximately 0.063 inches long in the machine direction. The widths of applicator and of the slots in the vacuum guide were approximately one inch less than the width of the paper web being treated.

The paper sheet was treated with the liquid treating composition under the following conditions:

| | |
|---|---|
| Paper speed | approximately 1500 ft/min. |
| Wet Coat Weight | 10.3 g/m$^2$ |
| Fluid Pressure | less than 0.04 psi |
| Vacuum Level | 5.39 psi |
| Application | No leakage or spillage of liquid |

EXAMPLE 7

In this example a foam applicator/vacuum guide combination, such as schematically shown in FIG. 7, was used having a distance $x_7$ between the vacuum guide and the fluid applicator of approximately 0.125 inches. The machine direction length of the vacuum guide surface of perforated metal was approximately 1.25 inches.

The paper web was treated with the liquid treating composition under the following conditions:

| | |
|---|---|
| Paper Sheet Speed | 1300 ft/min. |
| Wet Coat Weight | 12.4 gm/m$^2$ |
| Fluid Pressure | 1.9 psi |
| Vacuum Level | 4.9 psi |
| Application | No leakage or spillage of liquid |

EXAMPLE 8

In this example a foam applicator/vacuum guide combination, such as schematically shown in FIG. 3, was used having a distance $x_3$ between the vacuum guide and the fluid applicator of approximately 0.75 inches. The opening in the surface of the vacuum guide, cut into a stainless steel pipe of 0.5 inches inside diameter, was approximately 0.063 inches in machine direction length.

The paper web was treated with the liquid treating composition under the following conditions:

| | |
|---|---|
| Paper Speed | 1500 ft/min. |
| Wet Coat Weight | 10.3 g/m$^2$ |
| Fluid Pressure | 0.11 psi |
| Vacuum Level | 5.9 psi |
| Application | No spillage or leakage of liquid at application. |

We claim:

1. An apparatus for treating moving flexible sheet material comprising:
   (1) a vacuum guide having a surface for holding flexible sheet material with one or more openings in the surface, which openings extend to a chamber connected to vacuum generation means;
   (2) a short-dwell, fluid applicator adjacent to the vacuum guide, which fluid applicator comprises in combination;
      (a) a base;
      (b) an upstream lip and a parallel downstrip lip both extending angularly from the base;
      (c) a fluid application chamber extending between interior walls of each lip and closed at each end by end walls;

(d) one or more openings in the base providing movement of a uniform distribution of foam into the chamber from foam generation means;
(e) top inside and outside edges of the upstream lip;
(f) a top outside edge of the downstream lip;
(g) a rim between the top outside edge and the interior wall of the downstream lip;
(h) an upstream lip relief angle A formed by the inside edge and the interior wall of the upstream lip;
(i) a downstream lip relief angle B formed by the outside edge and the interior wall of the downstream lip;
(j) an orifice extending between the top inside edge of the upstream lip and the rim of the downstream lip effecting application of the foam to a substrate passing across the orifice; wherein,
(k) angle A is greater than or equal to 90°;
(1) angle B is less than 90°; and
(m) the upstream lip extends farther from the base than the downstream lip;

the applicator having a pair of lips extending in line with or a plane defined by the guide surface, with the fluid application chamber extending between the lips;

whereby the applicator is aligned with the vacuum guide sufficient to provide contact along the entire width of the applicator lips with a cross section of flexible sheet material passing to or from the guide surface across the applicator lips.

2. The apparatus of claim 1 wherein the flexible sheet material is paper.

3. The apparatus of claim 1 wherein a vacuum guide is provided on each side of the applicator.

4. The apparatus of claim 1 wherein the distance separating the vacuum guide from the applicator is from greater than 0 up to about 20 inches.

5. The apparatus of claim 1 wherein the distance separating the vacuum guide from the applicator is from 0 up to about 1 inch.

6. The apparatus of claim 5 wherein the vacuum guide is connected to the fluid applicator.

7. The apparatus of claim 6 wherein the surface of the vacuum guide intersects the lips of the fluid applicator.

* * * * *